US005547114A

United States Patent [19]

Mitchell

[11] Patent Number: 5,547,114

[45] Date of Patent: Aug. 20, 1996

[54] APPARATUS FOR BREAKING IN ATHLETIC GLOVES

[76] Inventor: Martin Mitchell, 51 De Groff Pl., Park Ridge, N.J. 07656

[21] Appl. No.: 404,525

[22] Filed: Mar. 15, 1995

[51] Int. Cl.[6] ..... A41H 43/00

[52] U.S. Cl. ..... 223/78; 73/11.02; 73/12.02

[58] Field of Search ..... 223/78, 79, 80; 73/11.08, 11.09, 12.02, 12.01, 11.04; 72/53, 376; 100/269.01

[56] References Cited

U.S. PATENT DOCUMENTS

| | | | |
|---|---|---|---|
| 1,383,475 | 7/1921 | McCabe | 72/376 |
| 1,636,234 | 7/1927 | Klopsteg | 73/12.02 |
| 2,267,662 | 12/1941 | Miller | 100/269.01 |
| 3,668,912 | 6/1972 | Baughman et al. | 72/53 |
| 4,036,415 | 7/1977 | Filko et al. | 223/78 |
| 4,759,281 | 7/1988 | Kasamatsuo et al. | 100/295 |
| 5,125,169 | 6/1992 | Bader | 223/78 |
| 5,271,321 | 12/1993 | Nordberg | 100/269.01 |
| 5,421,493 | 6/1995 | Ebeling, II | 223/78 |

FOREIGN PATENT DOCUMENTS

| | | | |
|---|---|---|---|
| 6201555 | 7/1994 | Japan | 73/12.12 |

*Primary Examiner*—Bibhu Mohanty
*Attorney, Agent, or Firm*—Morrison Law Firm

[57] ABSTRACT

Apparatus for breaking in or conditioning athletic gloves, especially baseball gloves, includes a holder on which the glove can be mounted, this holder being in the semblance of a human hand, an air-operated cylinder unit includes an impact member carried at a working end of a rod of the cylinder unit so that by stroking the rod in a glove striking direction, the impact member is caused to strike a palm part of the glove thereby softening the leather at the palm part, this being done repeatedly until a softened pocket is formed in the glove palm to facilitate a user's catching a baseball therein and easily folding the glove finger part over the caught ball.

14 Claims, 3 Drawing Sheets

APPARATUS FOR BREAKING IN ATHLETIC GLOVES

BACKGROUND OF THE INVENTION

The present invention relates to apparatus for breaking in athletic gloves and, more particularly, to apparatus which operates to effect break in of a glove in a matter of minutes as compared to prolonged periods of days or even weeks where known methods and devices used for such purpose are employed.

Effective and proper use of gloves for baseball and softball playing requires that a glove used have a pocket formed in a glove palm part in which a player can catch a baseball or softball, and then reflexively fold a glove finger part over the caught ball to securely retain it. New leather baseball gloves have leather which is quite stiff to the point that the leather must be softened for play use. In forming the glove pocket, a common practice is for a user to throw a ball against the palm repeatedly over a period and until the stiff leather of the glove palm becomes softened and especially so as compared to the leather of the adjacent glove finger part. By having differential of stiffness and softness around the pocket, the user easily can bend the glove finger part relative to the pocket part.

It also is known to use an oil or water to aid or hasten completion of a softening or breaking in of an athletic glove.

Additionally, devices are known for use in shaping, e.g., a pocket of an athletic glove, these devices being passive in use, that is, a glove is inserted in a device to give a certain shape to the glove, or a glove is wrapped around a device and secured in a wrapped shape to be held that way for a time until a shape is produced in the glove.

Patents which disclose passive use devices for shaping athletic gloves include U.S. Pat. Nos. 4,418,849; 4,765,519; 4,877,162 and 5,267,677. U.S. Pat. 1,425,969 discloses apparatus for the forming and shaping of fabric articles such as woolen dress gloves by heating a sewn or knit such article in a form with steam or other fluid.

In respect of breaking in leather athletic gloves, it is noted that while such is an activity most usually associated with the sports of baseball and softball, it has become a practice involved in the sport of ice hockey as well, where goalie's gloves are conditioned in the same manner as with baseball and softball gloves to enhance catching and holding of a hockey puck therewith.

OBJECTS AND SUMMARY OF THE INVENTION

Accordingly, it is an object of the invention to provide apparatus for breaking in or conditioning leather athletic gloves which overcomes the drawbacks of the prior art.

It is a further object of the invention to provide apparatus for conditioning leather athletic gloves of types used in the playing of the various sports inclusive of baseball, softball and hockey.

It is a still further object of the invention to provide apparatus for breaking in or conditioning leather athletic gloves which operates to effect such end purpose in a matter of minutes as compared to days, weeks and longer times associated with past practices.

Another object is to provide leather athletic glove conditioning apparatus which can be used to condition various types of gloves such as a fielder's glove, catcher's mitt or a first baseman's glove (both left and right handed such types), the apparatus being controllable to operate during conditioning for a cycle particular for the glove type involved.

Still another object is to provide glove conditioning apparatus which is compact in size, simple to operate and hence, is well suited for installation and use in sporting goods shops so that glove break in can be provided to a glove customer at the time a purchase is made.

A yet further object is to provide athletic glove conditioning apparatus in which a glove to be conditioned is mounted on a glove holder that is adjustable in respect of the stroking course of a glove impact member so that the glove can be positioned relative to the impact member in manner as to insure impacting at a precise location on, e.g., a pocket defining glove palm part.

Briefly stated, there is provided apparatus for breaking in or conditioning athletic gloves, especially baseball gloves, which apparatus includes a holder on which the glove can be mounted, this holder being in the semblance of a human hand. An air-operated cylinder unit is provided and includes an impact member carried at a working end of a rod of the cylinder unit so that by stroking the rod in a glove striking direction, the impact member is caused to strike a palm part of the glove thereby softening the leather at the palm part, this being done repeatedly until a softened pocket is formed in the glove palm to facilitate a user's catching a baseball therein and easily folding the glove finger part over the caught ball.

In accordance with these and other objects of the invention, there is provided apparatus for conditioning a leather athletic glove for use which conditioning includes softening at least a glove pocket defining palm part from a stiffened condition thereof to a condition thereof which is such softer than a leather condition in a glove finger part adjacent the pocket part that the glove finger part more readily can be moved relative to the pocket to close such finger part over an object caught by a user in the pocket. The apparatus comprises a holder on which the athletic glove can be received and held for presenting the glove palm part in a fixed positioning. An impact member is mounted for movement between a retracted position and an extended striking position wherein it strikes the athletic glove palm part with a leather softening impact force. Power operated means is connected to the impact member and is operable to cyclicly move the impact member between retracted and extended positions.

According to a further feature of the invention, there is provided apparatus for conditioning a leather athletic glove for use which conditioning includes softening at least a glove pocket defining palm part from a stiffened condition thereof to a condition thereof which is such softer than a leather condition in a glove finger part adjacent the pocket part that the glove finger part more readily can be moved relative to the pocket to close such finger part over an object caught by a user in the pocket. The apparatus includes a double acting pressurized fluid operated cylinder unit including a reciprocable cylinder rod movable in a straight-line travel course between a rod retracted position and a rod extended forward striking position and vice versa. This rod has a working end and an impact member is carried on the working end. A glove holder on which the athletic glove can be mounted with the pocket defining palm part transverse to the cylinder rod travel course is provided and is such that the glove palm part is held in position to be struck with leather softening force by the impact member when the cylinder rod is in extended forward striking position. Means for controlling operation of said cylinder unit so that the glove palm part is struck by the impact member a predetermined number of times also is provided.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

The apparatus of the invention offers the advantage of breaking in an athletic glove in but a few minutes as compared to days, weeks or months required where prior practice was used. With the apparatus, a new leather fielder's glove can be broken in a period of about 7 or 8 minutes. A catcher's mitt will take a longer time, for example, about 25 minutes. A first baseman's glove will require more time than a fielder's glove but not nearly that for a catcher's mitt, a first baseman's glove break in period generally being about 18 minutes. Further, the impact force used to soften the leather can be varied by the simple expedient of varying air pressure to a stroking cylinder unit which operates an impact member. The apparatus is used with both left handed and right handed gloves without any alteration on the apparatus itself.

Figure 1:
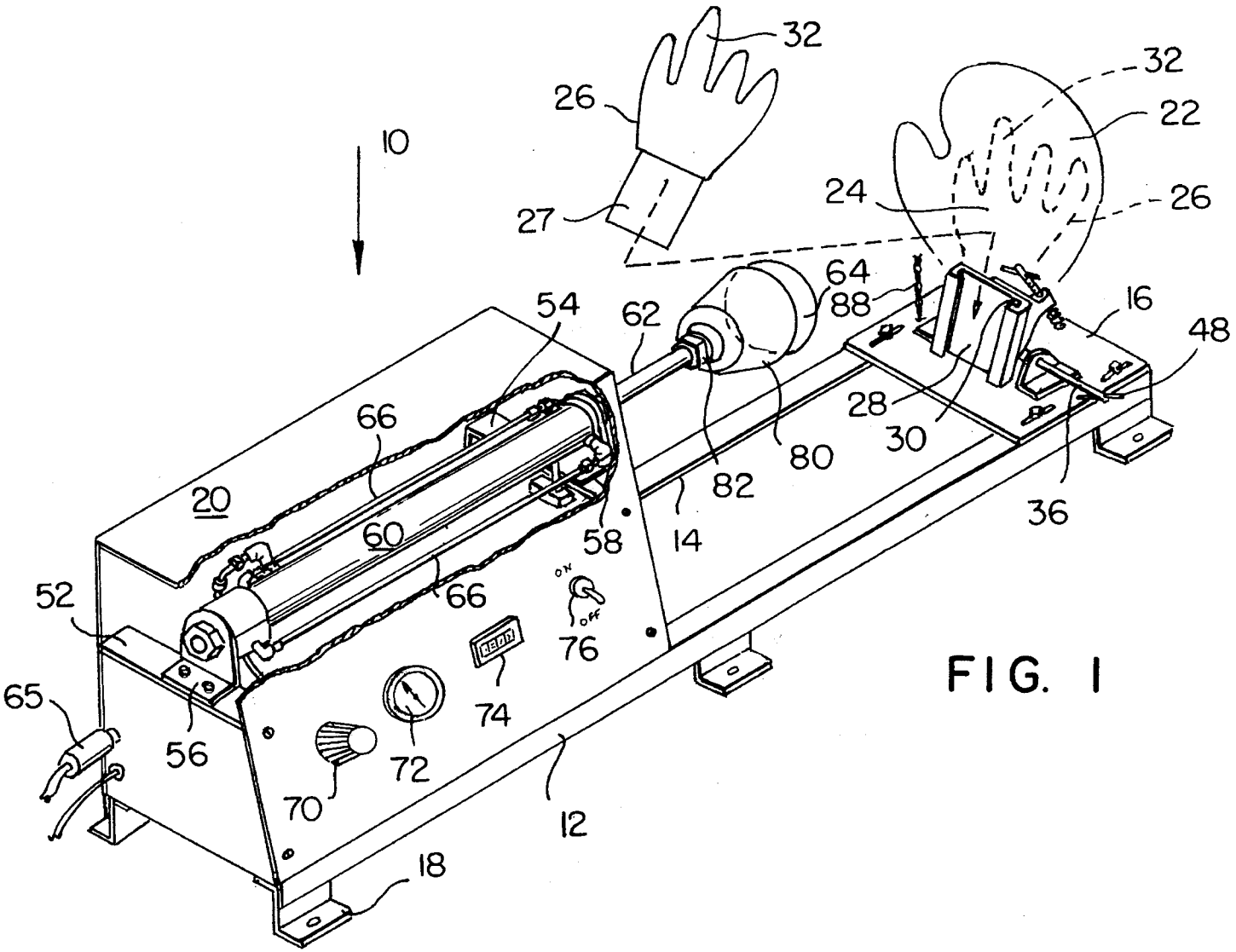
FIG. 1 is a perspective view, partly broken away and partly exploded illustrating glove conditioning apparatus constructed in accordance with the principles of the present invention.

The apparatus 10 shown in FIG. 1 is of compact construction and sized to be mounted readily on a counter top, table or bench at a site in a sports store, gymnasium, stadium etc where it advantageously is used for breaking in a glove. For such purpose, the apparatus has a base support structure including longitudinal supports 12, 14 and tie plate 16 connecting common ends of the supports. Feet or clips 18 are carried on the supports 12, 14 to secure the apparatus in a mounted condition. The supports provide structure on which the later described operating components are mounted, the operating components as well as certain controls being housed in a casing 20 fixed to the supports.

During conditioning of a glove 22, marked in part phantom, part full line outline in FIG. 1, the glove must be positioned in a fixed positioning wherein it presents a glove palm part 24 in location such as to be struck by an impact member as shall be described shortly. Positioning of the glove 22 for such purpose is by mounting the glove on a holder 26, the holder 26 being removably received in a socket member 28 carried on tie plate 16.

Glove holder 26 is made in the semblance of a human hand and has a lower flat, regular shaped part 27 that is slidably insertable into a slot 30 in the socket member 28 for holder mounting, the upper part of the holder having projecting finger structure, such finger structure including one fingerpiece 32 corresponding to a human index finger for use in properly locating a fielder's fingered glove on the holder. Socket member 28 has a rearwardly extending centrally positioned rib 29 which serves to mount impact force absorption means as will be noted later, it also serving to receive a screw means 33 for laterally adjustably positioning the socket member on the tie plate 16. This capacity to make lateral adjustments is desirable to account for the fact that athletic gloves come in various sizes and can have shape configurations particular to a given glove maker so it is necessary to be able to position the glove palm part in correct position by adjusting glove position.

Figure 5:
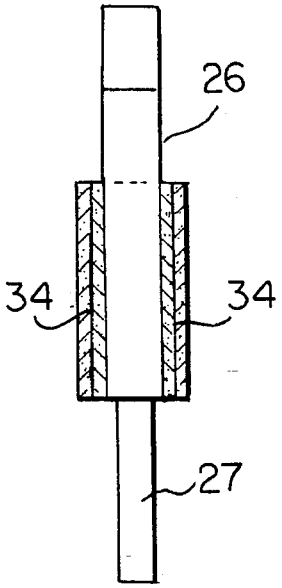
FIG. 5 is a side view on enlarged scale of the glove holder and showing the compressible material carried thereon at its opposite side faces.

The glove holder 26 is as seen from FIG. 5 a two-sided functional plate-like component in that in one facing position it is used for conditioning of a right handed glove while reversing the holder 180 degrees provides a facing position for use when conditioning a left handed glove. In the conditioning operation, cushioning of impact applied to a glove, i.e., absorbing impact force to, inter alia, prevent destructive effect on the glove by urging it forcefully against the relatively rigid holder is done with layers 34 of compressible material fixed on the holder at opposite faces thereof as seen from FIG. 5.

During impact of an impact member against a glove being conditioned, the socket member and glove holder are mounted such to yield to the impact force in manner as aid in absorption of the impact force generally and without adverse effect to the apparatus. As seen from FIG. 2, the socket member 28 is mounted on the tie plate 16 to be pivotable about an axis defined by pivot rod 36, the pivot rod being mounted in a pair of spaced support brackets 38 fixed on the tie plate, the pivot rod also serving as means with which lateral adjustment of the socket member relative to an impact member travel axis can be effected with screw means 33.

Figure 2:
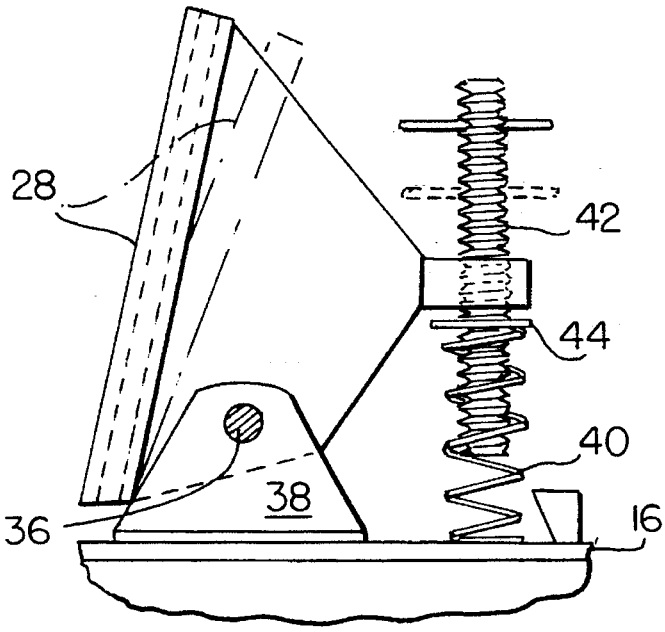
FIG. 2 is a fragmentary side elevational view on enlarged scale depicting the manner of mounting of the glove holder on the base support and how same can pivot counter to a spring bias during absorption of the impact blow applied to the glove during conditioning.

The socket member 28 can, responsive to impact force applied against a glove mounted thereon, pivot to a degree as shown, for example, by dashed lines in FIG. 2. This pivoting can be in opposition to a countering spring bias force imposed on the socket member with compression spring 40, the compression spring encircling a lower end length of an adjustment member 42, to which a ring 44 is fixed so that rotation of the member 42 tightens or loosens the bias effect of the spring on the socket member.

The impact force pivots the socket member clockwise but as soon as the impact force is released, the spring which during impact helps absorb impact, restores the socket member counterclockwise to initial (solid line) position. Spring 40 loosely engages tie plate 16 since the spring has to move across the tie plate when socket member lateral adjustment is made.

Figure 3:
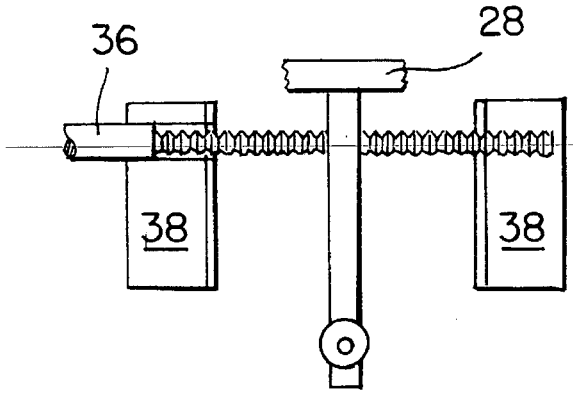
FIG. 3 is a fragmentary top plan view on enlarged scale showing how the glove holder can be adjusted laterally of the direction of impact member movement so as to enable optimal aligning of the glove palm part with the striking impact member.

Lateral adjustment of the socket member can, e.g., be effected by having the pivot rod 36 include a screw thread section 33, as seen from FIG. 3, with corresponding threaded parts in the socket member so that rotation of the rod with lever 48 will result in the socket member moving rightwardly or leftwardly. Other types of adjustment means could be used as long as it is understood that adjustment be possible to position the palm part of a glove being conditioned in optimum and/or required facing position to be struck by an impact member.

Adverting again to FIG. 1, the apparatus includes within casing 20, frame pieces 52, 54 on which is mounted with brackets 56, 58, a double acting air cylinder unit 60, the cylinder unit including a cylinder rod 62 having a working end on which is carried an impact member 64, the cylinder rod being connected internally of the cylinder with a piston member and having a longitudinal stroking direction.

Air under pressure from a source (not shown) can be delivered to the cylinder unit 60 via a quick disconnect fitting 65 and piping 66 to operate the cylinder unit and cause stroking of the rod in each of two opposite directions. In the forward or rightward stroking direction, the rod at the end of such stroke, drives the impact member into impact contact with the glove. In a retraction stroke, the rod 62 is returned leftwardly into the cylinder. The stroking is cycled in forward/retraction of the rod to the extent required to carry out the glove conditioning. This cycling can require, for example, about 375 impact strokes in conditioning a fielder's glove, about 850 strokes for a first baseman's glove and up to 1200 impact strokes when conditioning a catcher's glove.

The cylinder unit 60 preferably is an automatic reciprocating type such as one manufactured and sold by Allenair Corporation under designation Model No. VCR 1 and ½ X 12-RC-1F-AV. With such type of cylinder unit only air pressure at the source need be changed if for example, stroke cycle time is to be changed. Conventional operation of the cylinder unit with suitable valves and control devices also can be practiced. In operating with the preferred cylinder unit during actual glove conditioning, air pressure of 50 psig was found to be satisfactory.

Air pressure can be altered with a control 70 on the casing. An air pressure gauge 72 is mounted on the casing as is a cycle counter 74. An off/on switch can be provided as at 76.

Impact member 64 preferably is configured to have an external surface configuration which at least as to that which will impact the glove palm, is of hemispherical or partihemispherical shape. The impact member can be a batting practice ball which is made of a plastic or rubber and is of hard overall structure although the surface thereof is pliant. The impact member 64 can be configured in the semblance and size of a baseball or a softball.

It is convenient to removably mount the impact member on a working end of rod 62. Further the impact member can be fixed to a conical receptacle 80 which in turn is screw thread fitted to the rod. A lock nut 82 engages the receptacle to lock it against rotation on the rod during impact operation.

Figure 4:
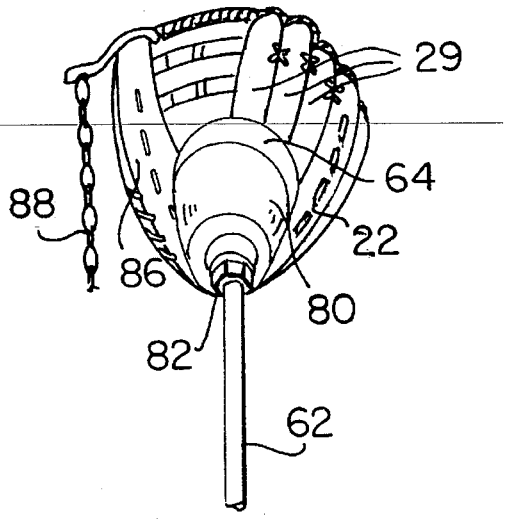
FIG. 4 is a fragmentary perspective view depicting the manner in which the impact member strikes the pocket region of the glove.
Figure 6:
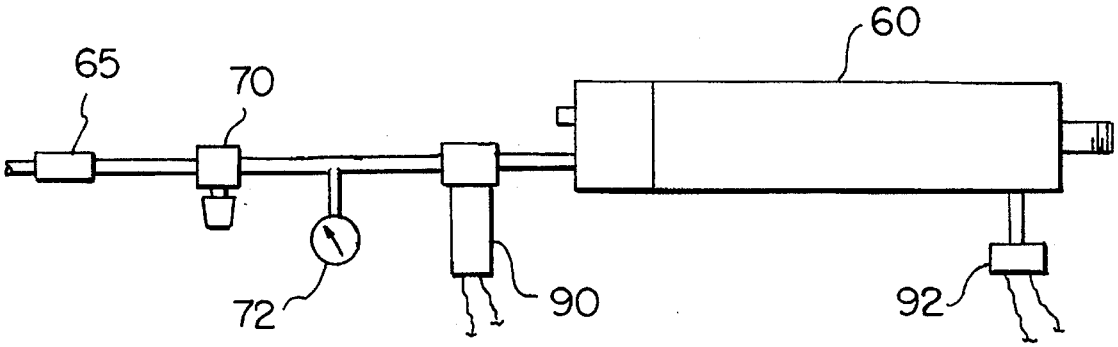
FIG. 6 is a schematic depiction showing a pneumatic arrangement which can be used in connection with retraction-extension of the impact member.

As indicated earlier, the rod 62 strokes longitudinally during conditioning. As seen from FIG. 4, glove 22 is during conditioning struck at the glove palm part (underlying the impact member in the Figure) to soften same so that stiffer leather in the glove finger section 29 more easily can be bent relative to the palm part wherein the glove pocket is formed.

During conditioning, it is advantageous to stay the glove thumb 86 to one side away from the stroking movement of the impact member. For such purpose, a chain or line member 88 can be secured at an end on the tie plate while a hook carried at an opposite end of the chain can be engaged with the glove webbing at the thumb to hold it away from the impact member. The chain can embody a resilient element to assure tension therein to hold the thumb.

Figure 7:
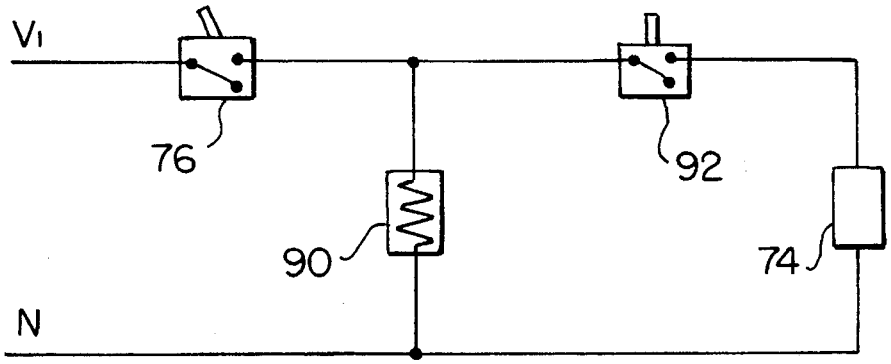
FIG. 7 is a simplified view of an electric circuit arrangement associated with the apparatus.

In operation and with air pressure available, closing of switch 76 will start the impact cycling. Closing of the switch 76 as seen from FIG. 7 actuates air solenoid 90 to admit air to the cylinder unit. A counter switch 92 is actuatable by rod movement so that the switch operates once for each stroke cycle to energize the counter 94. Switch 92 is actuated by an accessory pin such as an Allenair AB accessory pin in which a pin is thrown by cylinder rod stroking beginning about ⅛ inch before full stroke is completed, the pin movement, e.g., being used to actuate the counter switch.

After the requisite conditioning strokes, the switch 76 will be opened by a person using the apparatus. One of ordinary skill in the art readily will seen that a control tied in to the counter unit can be used to automatically shut down the apparatus after a set cycle count is reached.

A person skilled in the art also will appreciate that the cylinder unit could be operated with a fluid other than air, and that an electrical solenoid operated stroking unit could be used instead of a fluid unit. Further, the person skilled in the art would readily understand that extension/retraction movement of the impact member could be in a travel course other than that exemplified above in terms of a straightline travel. For example, a rotary cam could be used to pivot (extend) an arm carrying the impact member at an arm end giving the impact member an arcuate extension/retraction travel. A spring attached to the arm could be used to effect arm retraction and the rotary cam could be mounted on a motor output shaft.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for conditioning a leather athletic glove for use which conditioning includes softening at least a glove pocket defining palm part from a stiffened condition thereof to a condition thereof which is such softer than a leather condition in a glove finger part adjacent the pocket part that the glove finger part more readily can be moved relative to the pocket to close such finger part over an object caught by a user in the pocket, said apparatus comprising a holder on which the athletic glove can be mounted and held for presenting the glove palm part in a fixed positioning, an impact member mounted for movement in a travel course between a retracted position and an extended striking position wherein it strikes the athletic glove palm part with leather softening impact force, means for pivotably mounting said holder such that it has impact absorbing pivoting movement when the glove palm part is struck by the impact member, means for applying counter bias to said holder, said counter bias applying means being operable to return said holder from an impact induced pivoted position to an initial glove presenting position on movement of the impact member to retracted position, and power operated means connected to said impact member and operable to cyclicly move said impact member between said retracted and extended positions.

2. Athletic glove conditioning apparatus in accordance with claim 1 in which said power operated means comprises a cylinder unit having a piston rod carried reciprocable in the cylinder, the piston rod having a working end on which the impact member is carried.

3. Athletic glove conditioning apparatus in accordance with claim 2 in which the working end of the piston rod includes a receptacle removably mounting the impact member.

4. Athletic glove conditioning apparatus in accordance with claim 2 in which the cylinder unit is a fluid operated unit.

5. Athletic glove conditioning apparatus in accordance with claim 2 in which the cylinder unit is an air pressure operated double acting unit.

6. Athletic glove conditioning apparatus for conditioning a leather athletic glove for use which conditioning includes softening at least a glove pocket defining palm part from a stiffened condition thereof to a condition thereof which is such softer than a leather condition in a glove finger part adjacent the pocket part that the glove finger part more readily can be moved relative to the pocket to close such finger part over an object caught by a user in the pocket, said apparatus comprising a holder on which the athletic glove can be mounted and held for presenting the glove palm part in a fixed positioning, the holder comprising a plate carried on a base support, an impact member mounted on said base support for movement between a retracted position and an extended striking position wherein it strikes the athletic glove palm part with leather softening impact force, and power operated means connected to said impact member and operable to cyclicly move said impact member between said retracted and extended positions, the plate being a broad faced element configured in semblance of a human hand and having finger-like projections which can be received in the finger part of a glove mounted thereon.

7. Athletic glove conditioning apparatus in accordance with claim 3 in which the plate is carried on the base support readily removably in a socket fixed on the base support so that the plate which in one orientation thereof is used for conditioning a right-handed glove can be reverse orientation positioned in the socket for use when conditioning a left-handed glove.

8. Athletic glove conditioning apparatus in accordance with claim 6 in which respective ones of opposed side faces of the plate are covered with a layer of compressible material.

9. Athletic glove conditioning apparatus in accordance with claim 6 in which the impact member is supported on the base support to move in a longitudinal direction, the plate member being carried in a socket oriented such that the plate disposes transverse of said longitudinal direction, said socket being adjustably movable transversely of said longitudinal direction to locate the glove palm part coincident with the striking position of the impact member.

10. Athletic glove conditioning apparatus in accordance with claim 6 in which the impact member has an outer impacting surface thereof configured as a hemisphere or a part of a hemisphere.

11. Athletic glove conditioning apparatus in accordance with claim 6 in which the impact member is a shaped element of a plastic material.

12. Athletic glove conditioning apparatus in accordance with claim 11 in which the impact member is configured and sized as a baseball.

13. Athletic glove conditioning apparatus in accordance with claim 11 in which the impact member is configured and sized as a softball.

14. Athletic glove conditioning apparatus for conditioning a leather athletic glove for use which conditioning includes softening at least a glove pocket defining palm part from a stiffened condition thereof to a condition thereof which is such softer than a leather condition in a glove finger part adjacent the pocket part that the glove finger part more readily can be moved relative to the pocket to close such finger part over an object caught by a user in the pocket, said apparatus comprising a holder on which the athletic glove can be mounted and held for presenting the glove palm part in a fixed positioning, an impact member mounted for movement between a retracted position and an extended striking position wherein it strikes the athletic glove palm part with leather softening impact force, and power operated means connected to said impact member and operable to cyclicly move said impact member between said retracted and extended positions, the holder comprising a plate carried in a base support, said plate being carried on the base support such as to have impact force absorbing pivoting movement thereon, the impact member being movably supported on the base support, there being impact absorption means which engage said plate and apply counterbias to any impact force induced pivoting thereof, the impact force absorption means comprising a compression spring interveningly engaging said plate and said base support.

* * * * *